US010722081B2

(12) United States Patent
Achton

(10) Patent No.: US 10,722,081 B2
(45) Date of Patent: Jul. 28, 2020

(54) MATERIAL DISPENSER WITH MATERIAL LEVEL INDICATOR

(71) Applicant: ACHTON A/S, Farevejle (DK)

(72) Inventor: Kim Achton, Farevejle (DK)

(73) Assignee: ACHTON A/S, Farevejle (DK)

( * ) Notice: Subject to any disclaimer, the term of this patent is extended or adjusted under 35 U.S.C. 154(b) by 33 days.

(21) Appl. No.: 15/912,794

(22) Filed: Mar. 6, 2018

(65) Prior Publication Data

US 2018/0249870 A1 Sep. 6, 2018

(30) Foreign Application Priority Data

Mar. 6, 2017 (GB) ..... 1703570.0

(51) Int. Cl.
*A47K 10/38* (2006.01)
*A47K 10/32* (2006.01)

(52) U.S. Cl.
CPC ..... *A47K 10/38* (2013.01); *A47K 2010/3233* (2013.01)

(58) Field of Classification Search
CPC ..... A47K 10/22; A47K 10/34; A47K 10/36; A47K 10/38; A47K 2010/3233; A47K 2010/3675; A47K 2010/3681
See application file for complete search history.

(56) References Cited

U.S. PATENT DOCUMENTS 1,738,721 A * 12/1929 Morin ..... G07F 11/68 225/17
2,127,356 A * 8/1938 Grunwald ..... A47K 10/32 33/835
2,308,840 A * 1/1943 Vaughan ..... A47K 10/32 242/564.4
2,601,956 A * 7/1952 Birr ..... A47K 10/34 242/564.1
3,273,773 A * 9/1966 Eder ..... A47K 10/38 225/17
3,335,973 A * 8/1967 Genn ..... A47K 10/40 242/560.3

(Continued)

FOREIGN PATENT DOCUMENTS

EP 1206919 11/2000
EP 3372134 * 9/2018

(Continued)

*Primary Examiner* — William A. Rivera
(74) *Attorney, Agent, or Firm* — MacCord Mason PLLC

(57) ABSTRACT

A material dispenser comprising a housing, a mounting for a roll of material to be dispensed, and a material level indicator, in which said mounting comprises a first support member for rotationally supporting a first side of a roll of material to be dispensed in a plane, in which said material level indicator comprises an arm rotationally mounted to said dispenser at a pivot point, said arm comprising a visual indicator member at a first end thereof and a lateral abutment axially displaced from said visual indicator member for engaging with said first side of said roll of material, in which said arm is rotatable about said pivot point between a first position in which said arm is substantially parallel with said plane and said lateral abutment traverses said plane, and a second position in which said arm is arranged at an angle to said plane, and said lateral abutment and said visual indicator member are laterally displaced.

9 Claims, 3 Drawing Sheets

(56) References Cited

U.S. PATENT DOCUMENTS

| | | | | | |
|---|---|---|---|---|---|
| 3,575,328 | A * | 4/1971 | Jespersen | B65H 35/002 | 225/2 |
| 3,896,691 | A * | 7/1975 | Granger | B65H 35/0066 | 83/335 |
| 4,204,180 | A * | 5/1980 | Usui | B65H 23/005 | 226/11 |
| 4,756,485 | A * | 7/1988 | Bastian | A47K 10/3687 | 242/560.1 |
| 5,244,161 | A * | 9/1993 | Wirtz-Odenthal | A47K 10/3687 | 242/560.1 |
| 5,884,861 | A * | 3/1999 | Hosomi | B26D 1/305 | 242/563 |
| 6,517,025 | B1 * | 2/2003 | Budz | A47K 10/3818 | 242/563 |
| 6,550,714 | B1 * | 4/2003 | Granger | A47K 10/3643 | 242/564.4 |
| 8,240,928 | B2 * | 8/2012 | Tsugaru | B41J 29/02 | 400/582 |
| 9,326,647 | B2 * | 5/2016 | Larson | A47K 10/36 | |

FOREIGN PATENT DOCUMENTS

| | | | |
|---|---|---|---|
| GB | 2433247 | 12/2005 | 10/38 |
| GB | 2535356 | 11/2013 | |
| WO | WO 2013/172752 | 5/2012 | |

* cited by examiner

MATERIAL DISPENSER WITH MATERIAL LEVEL INDICATOR

The present invention relates to a material dispenser with a material level indicator, for use particularly, but not exclusively, with a paper hand towel dispenser.

Paper hand towel dispensers come in various forms, including simple housings from which pre-cut paper towels can be drawn, to more complex mechanisms which cut the towels from a web of paper towel material formed into a roll. One issue with the former type is the energy and resources required to manufacture the towels to be dispensed. The paper towels are cut and folded during manufacture, and then stacked and packaged for placement in a dispenser. With the latter dispenser type the manufacturing costs are lower because a web of paper towel material is easier to produce.

There are a number of known dispenser types which comprise an integrated cutting mechanism. One in particular uses a rotating drum to cut the paper towels and to eject them from the dispenser in a single movement. The roll of paper is arranged in a bay above the drum, and the drum is arranged in a path of the paper web extending from the bay to an outlet of the dispenser. The drum has a surface which frictionally engages the paper, so rotation of the drum draws the paper web from the roll and ejects it from the outlet. The drum comprises a knife of some kind which enters the path of the paper at a cutting angle of the drum, thereby to cut one paper towel from the web. In one version of this kind of product the drum comprises a spring loaded drive mechanism which rotates it through part of its 360 degrees of rotation from a launch angle to a start position. In use a user pulls on a section of the paper web protruding from the outlet, and this rotates the drum from the start position to the launch angle, due to the frictional engagement of the paper on the surface of the drum. Once the launch angle is reached the drum is then driven around the rest of its rotation, during which it cuts the paper web in order to deliver to the user one paper towel. The drive mechanism continues to rotate the drum after this so a section of the paper web is left protruding from the outlet.

An issue with this kind of paper towel dispenser is that the amount of paper web left on the roll cannot be determined without removing the front cover from the backplate to see inside the housing. As such, it is common for the roll to run out, and for the dispenser to be out of use until it is replaced, which may be some time later.

The present invention is intended to overcome some of the above described problems.

Therefore according to the present invention a material dispenser comprises a housing, a mounting for a roll of material to be dispensed, and a material level indicator, in which said mounting comprises a first support member for rotationally supporting a first side of a roll of material to be dispensed in a plane, in which said material level indicator comprises an arm rotationally mounted to said dispenser at a pivot point, and comprising a visual indicator member at a first end thereof, and a lateral abutment axially displaced from said visual indicator member for engaging with said first side of said roll of material, in which said arm is rotatable about said pivot point between a first position in which said arm is substantially parallel with said plane and said lateral abutment traverses said plane, and a second position in which said arm is arranged at an angle to said plane, and said lateral abutment and said visual indicator member are laterally displaced.

Thus, when a roll of material is placed in the dispenser its first side occupies the plane and laterally displaces the lateral abutment into the second position. This results in the visual indicator member also being laterally displaced. However, when the roll of material is depleted and the first side is reduced in diameter, the lateral abutment moves back into the first position. This results in the visual indicator member also returning to the first position. Therefore, the visual indicator member moves laterally between the second and first positions as the roll of material depletes, which can serve to indicate at least a full/empty status of the dispenser.

It will be appreciated that the pivot point can be located on the arm at a second end thereof, and therefore on an opposite side of lateral abutment to the visual indicator member. If so, in the second position both the lateral abutment and the visual indicator member are laterally displaced in the same direction away from the plane. However, in a preferred construction the pivot point can be located between the lateral abutment and the visual indicator member, such that in the second position the visual indicator member is laterally displaced towards the plane and the lateral abutment is laterally displaced away from the plane. This arrangement is more compact because the degree of lateral movement of the visual indicator member at the first end of the arm is less.

Preferably the dispenser can comprise a resilient element which biases the arm into the first position. Therefore, when the roll of material is placed in the dispenser it displaces the arm into the second position against the force of the resilient element, and when the roll of material is depleted the resilient element forces the arm back into the first position. This ensures that the material level indicator is accurate and does not deviate at any time from its functional indicative position.

It will be appreciated that the resilient element can be any resilient component which is capable of biasing the arm into the first position. This could be a spring such as a suitably mounted coil spring or leaf spring, which can be mounted in compression or extension. However, in a preferred construction the arm can comprise a second end which can be attached to the mounting, and the resilient element can comprise a portion of the arm between the second end and the pivot point, which is placed under extension in the second position. Therefore, the resilient element can be an integral part of the arm itself. This is an expedient construction as it reduces the number of parts of the dispenser. It will be appreciated that the arm can be constructed from any suitable material which is capable of providing the suitable resilience to the portion of the arm between the second end and the pivot point, such as any known resilient plastics material.

It will also be appreciated that the material level indicator of the invention can be binary, in the sense that it can assume just the first and the second positions, to indicate that the roll of material in the dispenser has material remaining on it, or not. The lateral abutment can be shaped such that it is maintained in the second position until the roll of material reaches a given level of depletion, at which point the roll of material no longer occupies the plane adjacent to the lateral abutment, and the arm moves back into the first position. This can occur at a point when there is still some material on the roll of material, but it needs replacing fairly shortly. As such, the material level indicator can operate as a simplex depletion warning system.

However, in a preferred construction the lateral abutment can comprise an axially facing surface which can extend from an inner end at the arm to an outer end at a furthest lateral extension of the lateral abutment, and the outer end can be rearward of the inner end, such that the surface is tapered in an axial direction of the arm. With this arrangement as the material of the roll of material decreases over time the lateral abutment moves incrementally from the second position to the first position, because the tapering surface allows the lateral abutment to move further through the plane as the circumference of the roll of material gets smaller. With this construction the material level indicator can operate as a functional gauge which indicates the present remaining level of material on the roll of material.

Preferrably the surface can comprise a convex curvature between the inner end and the outer end. This feature improves the functionality of the material level indicator because it prevents it from cutting into the side of the roll of material. It also means that the movement of the arm from the second position to the first position begins at a rate which is slower than the rate at which it completes the movement. As such, the material level indicator indicates the level of urgency of the need to replace the roll of material the more it depletes.

The housing can comprise an indicator aperture, and the visual indicator member can be at least partially visible through the indicator aperture. The visual indicator member can comprise a rectangular panel with a diagonal marking applied to it. The diagonal marking provides a graphical indication of the position of the visual indicator member as it moves past the indicator aperture when the arm moves from the second position to the first position. It can indicate to the viewer how much material is left on the roll of material. One side of the diagonal marking can be a first colour, for example white, and the other side of the diagonal marking can be a second colour, for example red. As such, when the arm is in the second position an all, or mostly, white section of the visual indicator member can be aligned with the indicator aperture to indicate that the roll of material is new, and when the arm is in the first position an all, or mostly, red section of the visual indicator member can be aligned with the indicator aperture to indicate that the roll of material is depleted. In addition, as the arm moves from the second position to the first position the relationship of visible white to red will change to indicate the present remaining level of material on the roll of material.

The present invention can be performed in various ways, but one embodiment will now be described by way of example and with reference to the accompanying drawings, in which.

Figure 1:
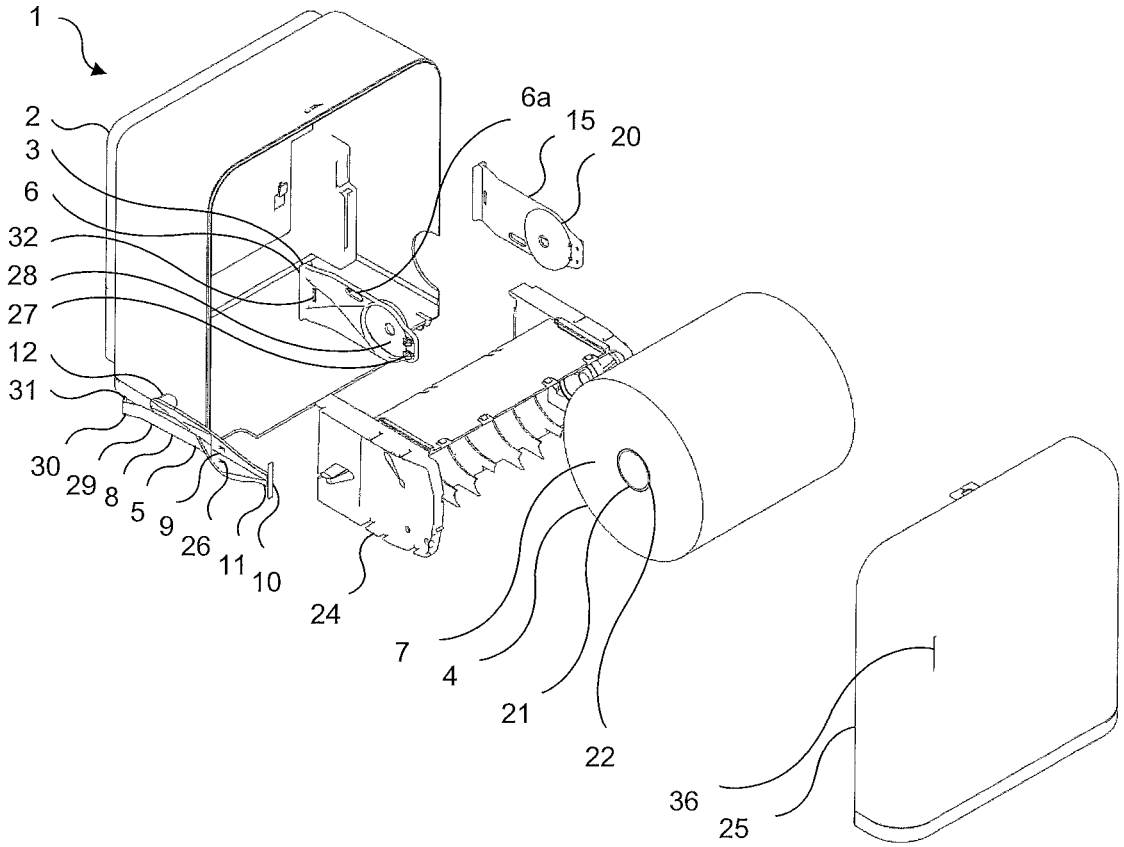
FIG. 1 is an exploded perspective view of a material dispenser according to the present invention.
Figure 7A:
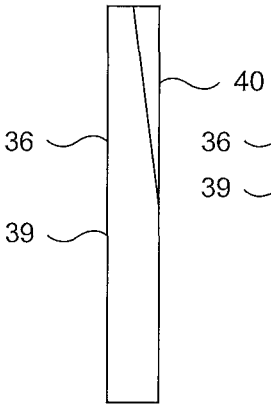
Figure 7B:
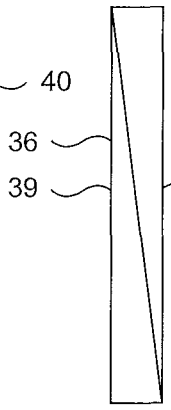
Figure 7C:
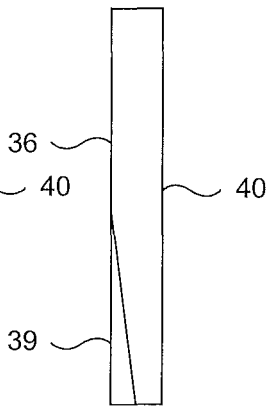

FIGS. 7*a* to 7*c* are diagrammatic front views of the material level indicator component of the material dispenser as shown in FIG. 1, as viewed through an indicator aperture feature of the material dispenser in the first, second and third states.

Figure 3:
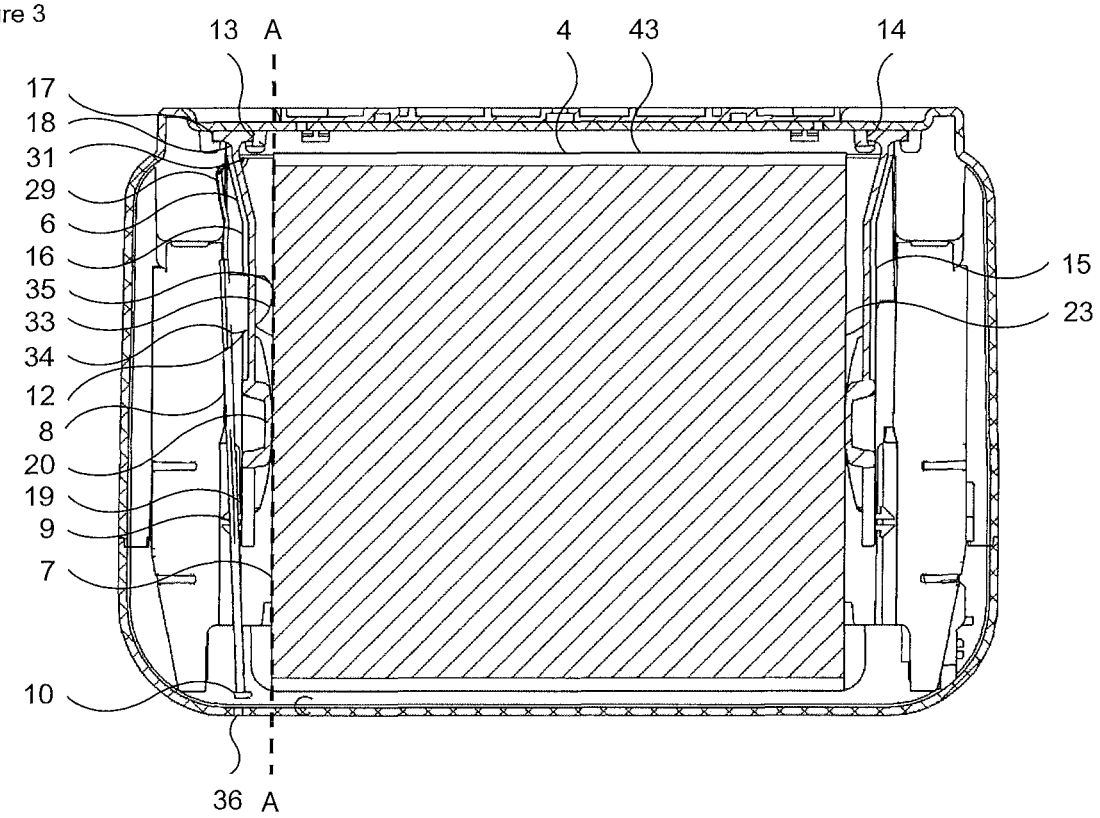
FIG. 3 is a cross sectional top view of the material dispenser as shown in FIG. 1, in a first state.
Figure 5:
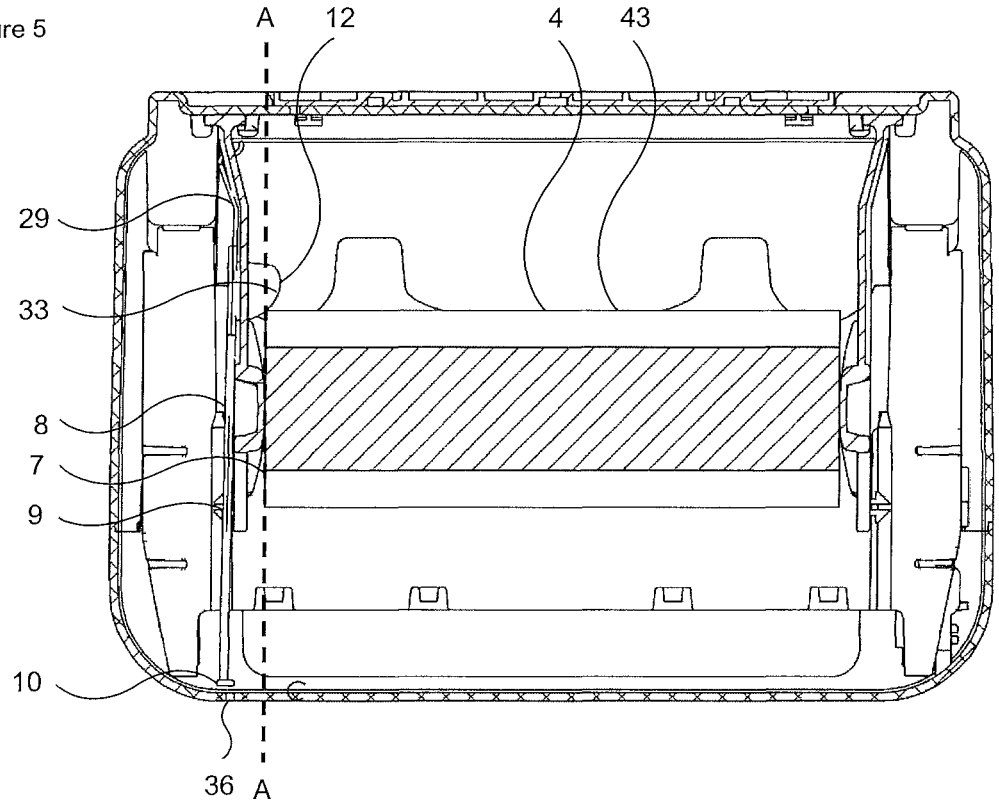
FIG. 5 is a cross-sectional top view of the material dispenser as shown in FIG. 1, in a third state.

As shown in the Figures a material dispenser 1 comprises a housing 2, a mounting 3 for a roll of material to be dispensed, in the form of web of paper towel material formed into roll 4, and a material level indicator 5. The mounting 3 comprises a first support member 6 for rotationally supporting a first side 7 of the roll 4 in a plane A. The material level indicator 5 comprises an arm 8 rotationally mounted to the dispenser 1 at a pivot point 9; the arm comprising a visual indicator member 10 at a first end 11 thereof and a lateral abutment 12 axially displaced from the visual indicator member 10 for engaging with the first side 7 of the roll of material 4. The arm 8 is rotatable about the pivot point 9 between a first position, as shown in FIG. 5, in which the arm 8 is substantially parallel with the plane A, and the lateral abutment 12 traverses the plane A, and a second position, as shown in FIG. 3, in which the arm 8 is arranged at an angle to the plane A, and the lateral abutment 12 and visual indicator member 10 are laterally displaced.

The material dispenser 1 is like known devices of a similar construction. The housing 2 is adapted to be mounted on a wall. Inside the housing 2 are two sockets 13 and 14 (visible in FIG. 3), which support the first support member 6 and a second support member 15 of a similar construction. In each case the first support member 6 and the second support member 15 comprise a resilient plate 16 with a mounting foot 17 at an inner end 18 thereof, which slots into the respective socket 13 or 14 so the first support member 6 and second support member 15 are disposed substantially normally to the housing 2. At an outer end 19 of the resilient plate 16 is an annular mounting boss 20, which in the case of first support member 6 supports the first side 7 of the roll 4 by engaging a first side 21 of central aperture 22, and which in the case of second support member 15 supports a second side 23 of the roll 4 by engaging a second side (not visible) of central aperture 22. The roll 4 is supported by the first support member 6 and the second support member 15 such that it can rotate in order for the web paper to be unfurled therefrom.

An end of the paper web from the roll 4 is fed into a dispensing mechanism 24 which is mounted in the housing 2 below the roll 4. The dispensing mechanism 24 is of a known kind which uses a rotating drum to cut the paper web into individual paper towels and to eject them from the dispenser in a single movement. The drum has a surface which frictionally engages the paper, so rotation of the drum draws the paper web from the roll 4 and ejects it from an outlet (not visible) on the underside of the housing 2. The drum comprises a knife which enters the path of the paper web at a cutting angle of the drum, thereby to cut one paper towel therefrom. The drum comprises a spring loaded drive mechanism which rotates it through part of its 360 degrees of rotation from a launch angle to a start position. In use a user pulls on a section of paper web material protruding from the outlet, and this rotates the drum from the start position to the launch angle, due to the frictional engagement of the paper web on the surface of the drum. Once the launch angle is reached the drum is then driven around the rest of its rotation, during which it cuts the paper web in order to deliver to the user one paper towel. The drive mechanism continues to rotate the drum after this so a section of the paper web is left protruding from the outlet.

The housing 2 has a removable cover 25 which encloses the roll 4 and the dispensing mechanism 24.

Figure 2:
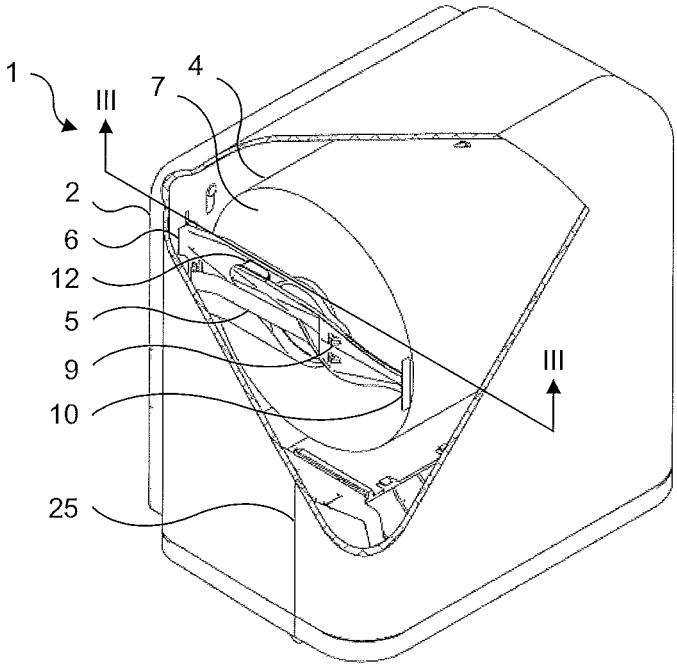
FIG. 2 is a perspective view of the material dispenser as shown in FIG. 1, with a section removed for illustrative purposes.

Referring to the material level indicator 5, the arm 8 comprises a pair of mounting slots 26 which mount onto a pair of resilient bosses 27 provided on an outer surface 28 of the first support member 6, in a snap-fit arrangement. This interconnection provides the pivot point 9 of the arm 8, as it is the point at which the arm 8 rotates in use, as described further below. The first support member 6 comprises an access slot 6*a*, and as is clear from FIGS. 2 and 3, when the arm 8 is mounted to the outer surface 28 of the first support member 6, the lateral abutment protrudes through the access slot 6*a*. This allows the lateral abutment 12 to move freely between the first and second positions.

As is clear from the figures, the pivot point 9 is located approximately half way between the lateral abutment 12 and the visual indicator member 10. This means that in the second position as shown in FIG. 3 the visual indicator 10 is laterally displaced towards plane A and the lateral abutment 12 is laterally displaced away from plane A, because the arm 8 is rotated about the pivot point 9 in an anti-clockwise direction as viewed from above.

The material level indicator 5 further comprises a resilient element 29 which biases the arm 8 into the first position, as shown in FIG. 5. The arm 8 has a second end 30 which comprises a hook 31, which is disposed in a catch slot 32 provided on the first support member 6. The resilient element 29 comprises the portion of the arm 8 between the second end 30 and the pivot point 9, which is placed under extension in the second position, as shown in FIG. 3, by virtue of the lateral abutment 12 being forced away from plane A. Therefore, the resilient element 29 is an integral part of the arm 8 itself. The arm 8 is constructed from a resilient plastics material so it can flex in the manner described in use without failure.

Therefore, when the roll 4 is placed in the dispenser it displaces the arm 8 into the second position against the force of the resilient element 29, and when the roll 4 is depleted, as shown in FIG. 5, the resilient element 29 forces the arm 8 back into the first position. This ensures that the material level indicator 5 is accurate and does not deviate at any time from its functional indicative position.

Referring to FIG. 3, the lateral abutment 12 comprises an axially facing surface 33 which extends from an inner end 34 at the arm 8 to an outer end 35 at a furthest lateral extension of the lateral abutment 12. As is clear from the Figures, the outer end 35 is rearward of the inner end 34, such that the surface 33 is tapered in an axial direction of the arm 8. Furthermore, the surface 33 comprises a convex curvature between the inner end 34 and the outer end 35.

With this arrangement as the diameter of the roll 4 decreases over time the lateral abutment 12 moves incrementally from the second position, as shown in FIG. 3, to the first position, as shown in FIG. 5, because the tapering surface 33 allows the lateral abutment 12 to move further through the plane A as the diameter of the roll 4 gets smaller. As such, the material level indicator 5 operates as a functional gauge which indicates the present remaining level of paper web on the roll 4. The convex curvature of the surface 33 improves the functionality of the material level indicator 5 because it prevents it from cutting into the side of the roll 4. It also means that the movement of the arm 8 from the second position to the first position begins at a rate which is slower than the rate at which it completes the movement. As such, the material level indicator 5 indicates the level of urgency of the need to replace the roll 4 the more it depletes.

The cover 25 comprise an indicator aperture 36, and the visual indicator member 10 is visible through the indicator aperture 36. The visual indicator member 10 comprises a rectangular panel 37 with a diagonal marking 38 applied to it, and this is shown face-on in FIG. 6. The diagonal marking 38 is provided by having a first side 39 of the panel 37 coloured white, and a second side 40 of the panel 37 coloured red, and having the line between the colours diagonal. The diagonal marking 38 provides a graphical indication of the position of the visual indicator member 10 as it moves past the indicator aperture 36 when the arm 8 moves from the second position to the first position. It can indicate to the viewer how much paper web is left on the roll 4.

Figure 6:
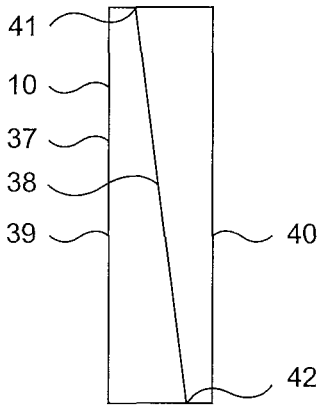
FIG. 6 is a front view of a material level indicator component of the material dispenser as shown in FIG. 1.

It will be appreciated from FIG. 6 that the diagonal marking 38 does not extend from the corners of the panel 37, but from points 41 and 42 which are located closer to a centre line of the panel 37. As explained below, this ensures that when the visual indicator member 10 is centrally aligned with the indicator aperture 10 in an intermediary position of the arm 8, it displays a half white half red indication, which informs the user that the dispenser is about half full of paper.

Referring to FIGS. 7*a* to 7*c*, these show views of the visual indicator member 10 through the indicator aperture 36, which is half the width of the visual indicator member 10, in the second position, an intermediary position and the first position, respectively.

As shown in FIG. 7*a*, when the roll 4 is new and the lateral abutment 12 is displaced away from plane A such that the visual indicator member 10 is displaced towards plane A, most of the visual indicator member 10 visible through the indicator aperture 36 is white. This indicates a full state of the dispenser 1.

As shown in FIG. 7*c*, when the roll 4 is depleted and the lateral abutment 12 passes through plane A such that the visual indicator member 10 is displaced away from plane A by the resilient element 29, most of the visual indicator member 10 visible through the indicator aperture 36 is red. This indicates the depleted state of the dispenser 1.

Figure 4:
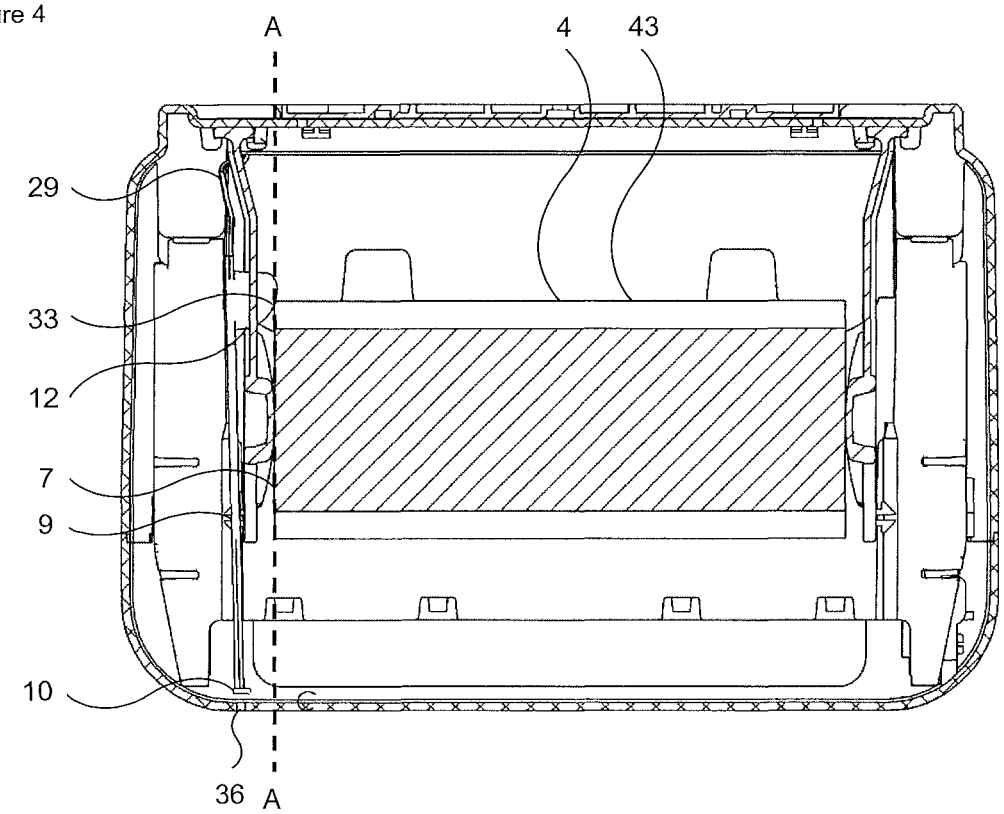
FIG. 4 is a cross-sectional top view of the material dispenser as shown in FIG. 1, in a second state.

As shown in FIG. 7*b*, when the roll 4 is half depleted and the lateral abutment 12 is in an intermediary position, as shown in FIG. 4, the visual indicator member 10 displays a half white half red indication, as mentioned above, which informs the user that the dispenser 1 is half full of paper.

It will be appreciated that as the roll 4 depletes the position of the visual indicator member 10 will change incrementally, to display a live indication of the level of paper web left on the roll 4.

Therefore, in use the user removes the cover 25 from the housing 2 and places a new roll 4 between the first support member 6 and the second support member 15, by manually flexing them outwards. The end of the paper web on the roll 4 is fed into the dispensing mechanism 24 and the dispensing mechanism 24 operated once to feed the paper web 4 over the drum and to the outlet.

As the first side 7 of the roll 4 passes through plane A the lateral abutment 12 is displaced away from plane A, placing the resilient element 29 under extension. The arm 8 is rotated about the pivot point 9, and the visual indicator member 10 is displaced towards plane A. Therefore, when the user replaces the cover 25, the view of the visual indicator member 10 through the indicator aperture 36 is as shown in FIG. 7*a*. This is mostly white to indicate the full state of the dispenser 1.

As the dispenser 1 is used the diameter of the roll 4 decreases incrementally by the width of the paper web each time the roll 4 rotates through 360 degrees. For most of the first half of the life of the roll 4 this has no effect on the position of the material level indicator 5. As is clear from FIG. 3, the lateral abutment 12 is disposed some distance from the surface 43 of the roll 4 when it is new. About 40 percent of the roll 4 must be depleted before the lateral abutment 12 begins to function. This means that the visual indicator member 10 continues to display a full state of the dispenser 1 during this period, as shown in FIG. 7*a*. This is acceptable as the roll 4 does not need to be replaced, and nor do service personnel need to be warned that it will need immanent replacement.

Once the surface 43 of the roll 4 aligns with the outer end 35 of the surface 33, the lateral abutment 12 will being to move incrementally from the second position towards the first position. This movement begins at a rate which is slower than the rate at which it is completed because of the convex curvature of the surface 33. As such, the material level indicator 5 indicates the level of urgency of the need to replace the roll 4 the more it depletes. FIG. 4 shows the lateral abutment 12 in an intermediary position about half way between the second position and the first position. As such, the arm 8 has rotated about the pivot point 9 under the extension force of the resilient element 29, and the visual indicator member 10 has moved half way across the face of the indicator aperture 36. As such, the visual indicator member 10 displays the half white half red indication as shown in FIG. 7*b*. This shows to service personnel that the roll 4 is about half depleted, and will need replacement soon.

When the surface 43 of the roll 4 has moved past the lateral abutment 12 to such an extent that the material level indicator 5 has returned to the first position, the arm 8 has rotated about the pivot point 9 such that the visual indicator member 10 has moved fully across the face of the indicator aperture 36. As such, the visual indicator member 10 displays the mostly red indication as shown in FIG. 7*c*. This shows to service personnel that the roll 4 needs to be replaced. As is clear from FIG. 5, the roll 4 still has a certain amount of the paper web on it, and as such it will continue to dispense paper towels. The material level indicator 5 is arranged in this way because a service person may only inspect the dispenser 1 periodically, and it may be preferred to replace a roll 4 which is so low that it will be depleted before they return again. This prevents there being any significant period when the roll 4 is completely depleted and the dispenser 1 cannot be used.

To replace the roll 4 the user removes the cover 25 from the housing 2 and removes the depleted roll 4 from between the first support member 6 and the second support member 15, by manually flexing them outwards. They can then place a new roll 4 in the dispenser as described above.

It will be appreciated that dispenser 1 can be altered without departing from the scope of claim 1.

For example, in other embodiments (not shown) the material level indicator is arranged to display the depleted state of the roll 4 earlier or later, by having the lateral abutment 12 further away or closer to the axis of the roll 4.

In another alternative embodiment (not shown) the material level indicator is binary and assumes just the first and the second positions, to indicate that the roll of material in the dispenser has material remaining on it, or not. In such an alternative embodiment the lateral abutment is shaped such that it is maintained in the second position until the roll of material reaches a given level of depletion, at which point the roll of material no longer occupies the plane adjacent to the lateral abutment, and the arm moves back into the first position. This can be arranged to occur at a point when there is still some material on the roll, but it needs replacing fairly shortly. As such, the material level indicator operates as a simplex depletion warning system.

In another alternative embodiment (not shown) the pivot point is located on the arm at the second end thereof, and therefore on the opposite side of lateral abutment to the visual indicator member. As such, in the second position both the lateral abutment and the visual indicator member are laterally displaced in the same direction away from the plane.

Therefore, the present invention provides a material dispenser with a simple and effective mechanism to display the live state of depletion of the roll of paper web inside it. The mechanism is simplex because it is made up of only one additional structural part, namely the material level indicator, which can be mounted to the first support member for pivoting and resilient biasing, and which can be visible through the indicator aperture formed in the cover. The invention also provides an arrangement whereby the roll is indicated as being depleted before it actually is fully depleted, to allow service personnel to replace the roll prior to it becoming fully depleted.

The invention claimed is:

1. A material dispenser comprising a housing, a mounting for a roll of material to be dispensed, and a material level indicator, in which said mounting comprises a first support member for rotationally supporting a first side of a roll of material to be dispensed in a plane, in which said material level indicator comprises an arm rotationally mounted to said dispenser at a pivot point, said arm comprising a visual indicator member at a first end thereof and a lateral abutment axially displaced from said visual indicator member for engaging with said first side of said roll of material, in which said arm is rotatable about said pivot point between a first position in which said arm is substantially parallel with said plane and said lateral abutment traverses said plane, and a second position in which said arm is arranged at an angle to said plane, and said lateral abutment and said visual indicator member are laterally displaced, wherein said pivot point is located between said lateral abutment and said visual indicator member, such that in said second position said visual indicator member is laterally displaced towards said plane and said lateral abutment is laterally displaced away from said plane.

2. A dispenser as claimed in claim 1 in which said dispenser comprises a resilient element which biases said arm into said first position.

3. A dispenser as claimed in claim 2 in which said arm comprises a second end which is attached to said mounting, and in which said resilient element comprises a portion of said arm between said second end and said pivot point, which is placed under extension in said second position.

4. A material dispenser comprising a housing, a mounting for a roll of material to be dispensed, and a material level indicator, in which said mounting comprises a first support member for rotationally supporting a first side of a roll of material to be dispensed in a plane, in which said material level indicator comprises an arm rotationally mounted to said dispenser at a pivot point, said arm comprising a visual indicator member at a first end thereof and a lateral abutment axially displaced from said visual indicator member for engaging with said first side of said roll of material, in which said arm is rotatable about said pivot point between a first position in which said arm is substantially parallel with said plane and said lateral abutment traverses said plane, and a second position in which said arm is arranged at an angle to said plane, and said lateral abutment and said visual indicator member are laterally displaced, wherein said lateral abutment comprises an axially facing surface which extends from an inner end at said arm to an outer end at a furthest lateral extension of said lateral abutment, and in which said outer end is rearward of said inner end, such that said surface is tapered in an axial direction of said arm.

5. A dispenser as claimed in claim 4 in which said surface comprises a convex curvature between said inner end and said outer end.

6. A material dispenser comprising a housing, a mounting for a roll of material to be dispensed, and a material level indicator, in which said mounting comprises a first support member, an outer end of which comprises a mounting boss for rotationally supporting a roll of material to be dispensed so it can rotate on an axis in order for the material to be unfurled therefrom, and so a first side of said roll of material is disposed in a plane orthogonal to said axis, in which said material level indicator comprises an arm rotationally mounted to said dispenser at a pivot point, said arm comprising a visual indicator member at a first end thereof and a lateral abutment axially displaced from said visual indicator member for engaging with said first side of said roll of material, in which said arm is rotatable about said pivot point between a first position in which said arm is substantially parallel with said plane and said lateral abutment traverses said plane, and a second position in which said arm is arranged at an angle to said plane, and said lateral abutment and said visual indicator member are laterally displaced.

7. A dispenser as claimed in claim 6 in which said housing comprises an indicator aperture, and in which said visual indicator member is at least partially visible through said indicator aperture.

8. A dispenser as claimed in claim 7 in which said visual indicator member comprises a rectangular panel with a diagonal marking applied to it.

9. A dispenser as claimed in claim 6 in which said pivot point is located at a second end of said arm, such that in said second position said visual indicator and said lateral abutment are laterally displaced away from said plane.

* * * * *